US010179671B2

(12) United States Patent
Umentum et al.

(10) Patent No.: US 10,179,671 B2
(45) Date of Patent: Jan. 15, 2019

(54) DISPENSER-PACKAGING FOR PROTECTIVE EYEWEAR

(71) Applicant: TIDI Products, LLC, Neenah, WI (US)

(72) Inventors: Katie Umentum, De Pere, WI (US); Rob Sweitzer, Wauwatosa, WI (US); Brian Wilt, Appleton, WI (US); Bradly Thomas Schultz, Greenville, WI (US)

(73) Assignee: TIDI Products, LLC, Neenah, WI (US)

( * ) Notice: Subject to any disclaimer, the term of this patent is extended or adjusted under 35 U.S.C. 154(b) by 243 days.

(21) Appl. No.: 14/213,416

(22) Filed: Mar. 14, 2014

(65) Prior Publication Data

US 2015/0203282 A1 Jul. 23, 2015

Related U.S. Application Data

(60) Provisional application No. 61/792,371, filed on Mar. 15, 2013.

(51) Int. Cl.
*B65D 5/50* (2006.01)
*B65D 5/72* (2006.01)

(52) U.S. Cl.
CPC ..... *B65D 5/5035* (2013.01); *B65D 5/724* (2013.01); *B65D 5/725* (2013.01)

(58) Field of Classification Search
CPC ..... B65D 5/724; B65D 5/725; B65D 5/5035; B65D 17/161; B65D 85/00; B65D 85/62; B65D 2583/00
See application file for complete search history.

(56) References Cited

U.S. PATENT DOCUMENTS 3,207,380 A 9/1965 Hennessey
3,265,283 A 8/1966 Farquhar
3,352,425 A * 11/1967 Burke ..... A47F 7/021 211/85.1
3,836,007 A * 9/1974 Rosenwein ..... A47F 7/021 116/75

(Continued)

OTHER PUBLICATIONS

USPTO Final Office Action of U.S. Appl. No. 14/264,206 dated Aug. 6, 2015.

(Continued)

*Primary Examiner* — Gene O Crawford
*Assistant Examiner* — Kevin L Randall, Jr.
(74) *Attorney, Agent, or Firm* — Boyle Fredrickson, S.C.

(57) ABSTRACT

Aspects of the invention provide a dispenser-package for storing protective eyewear glasses comprising an exterior box having a top, a bottom and four sidewalls along a first length, and an interior retention mechanism for holding a plurality of protective eyewear glasses along a second length. The exterior box completely receives the interior retention mechanism and securely holds the plurality of protective eyewear glasses in place. The exterior box includes a detachable area in proximity to the bottom to allow accessing one or more of the protective eyewear glasses held in place. As a result, a more convenient and efficient way to store and distribute protective eyewear glasses encourages healthcare professionals and patients to wear them and maintain personal safety.

20 Claims, 16 Drawing Sheets

(56) References Cited

U.S. PATENT DOCUMENTS 4,269,315 A * 5/1981 Boyce ..... B65D 77/062 128/206.19
4,752,029 A 6/1988 Buford
4,767,022 A * 8/1988 Oldorf ..... G07F 11/18 221/191
4,805,765 A 2/1989 Barrett et al.
4,899,929 A 2/1990 Grollman
5,249,737 A 10/1993 Fritz et al.
5,370,220 A * 12/1994 Wang ..... A47F 1/08 206/499
5,615,767 A * 4/1997 Eull ..... B65D 5/5023 206/278
5,642,837 A * 7/1997 Hayes ..... B65D 83/08 221/197
5,794,782 A * 8/1998 Ascik ..... A47F 11/04 206/600
5,836,478 A 11/1998 Weiss
6,253,930 B1 7/2001 Freidus et al.
6,708,841 B2 * 3/2004 Baughman ..... A61B 42/40 221/155
6,929,133 B1 * 8/2005 Knapp, III ..... A47F 5/0807 211/118
7,648,048 B2 1/2010 Smith
7,658,317 B2 2/2010 Wilkins
7,922,035 B2 * 4/2011 Long ..... B65H 45/24 221/45
8,136,697 B2 3/2012 Hackney
8,485,423 B2 * 7/2013 Thomas ..... B65D 71/36 221/302
2002/0036156 A1 * 3/2002 Knaack ..... B65D 5/4204 206/778
2002/0175177 A1 11/2002 Jepson
2004/0056043 A1 * 3/2004 Griesbach, III ..... A41D 13/11 221/303
2005/0199690 A1 9/2005 Peterson
2007/0152028 A1 7/2007 McGowan
2007/0262086 A1 * 11/2007 Cook ..... B65D 5/001 221/305
2009/0188015 A1 * 7/2009 Grad ..... A61F 9/025 2/15
2011/0079532 A1 * 4/2011 Eck ..... A47G 19/23 206/516
2012/0012502 A1 * 1/2012 Young ..... A45C 11/04 206/736
2012/0272437 A1 * 11/2012 Grad ..... A61F 9/025 2/431
2014/0076918 A1 * 3/2014 Hailey ..... B65D 77/02 221/45
2014/0319205 A1 * 10/2014 Schultz ..... B65D 5/725 229/122.1

OTHER PUBLICATIONS

USPTO Non-Final Office Action of U.S. Appl. No. 14/264,206 dated Mar. 17, 2015.

* cited by examiner

DISPENSER-PACKAGING FOR PROTECTIVE EYEWEAR

CROSS-REFERENCE(S) TO RELATED APPLICATION(S)

This application claims a benefit of priority under 35 USC § 119 based on U.S. Provisional Patent Application No. 61/792,371, filed Mar. 15, 2013, the entire contents of which are hereby expressly incorporated by reference into the present application.

BACKGROUND OF THE INVENTION

The present invention relates to the field of medical supply packaging. In particular, the invention is related to packaging and dispensing for protective eyewear glasses.

Manufacturers of protective eyewear glasses oftentimes package and ship products in conventional boxes. Once boxes arrive at a healthcare facility, they are typically opened and groups of protective eyewear glasses are stored in drawers or on shelves. When a pair of protective eyewear glasses is needed, a healthcare professional will typically look through the various drawers and/or shelves to retrieve them.

In some instances, once boxes arrive at a healthcare facility, protective eyewear glasses may remain permanently in the boxes until a pair of protective eyewear glasses is needed. Boxes may be placed on a shelf or in a closet, and when needed, a box is located by the healthcare professional and a pair of protective eyewear glasses is retrieved from the box individually. Each time a pair of protective eyewear glasses is retrieved, the entire box is opened and closed, thereby compromising the integrity of the box and potentially disheveling the contents of the box with retrieval.

These approaches often lead to inconvenience to the healthcare professional. In particular, locating a pair of protective eyewear glasses and/or a box containing protective eyewear glasses may be inconvenient and highly time consuming. As a result, in some instances healthcare professionals and/or patients may become inclined to avoid wearing protective eyewear glasses in some instances, thereby compromising personal safety. What is needed is a convenient and efficient way to store and distribute protective eyewear glasses in a healthcare environment.

SUMMARY AND OBJECTS OF THE INVENTION

In accordance with an aspect of the invention, methods and apparatuses are provided for packaging protective eyewear glasses in a manner allowing ease of distribution and use. Once a package in accordance with the invention arrives at a healthcare facility, the package may be inserted in a permanent wall-mounted location and a lower end of the package may be detached. As such, protective eyewear glasses may be singly retrieved until the package is empty, at which point, the package may be discarded with a replacement package being inserted in its place in the permanent wall-mounted location. As a result, a more convenient and efficient way to store and distribute protective eyewear glasses encourages healthcare professionals and patients to wear them and maintain personal safety.

Specifically, one aspect of the present invention includes a dispenser-package for storing protective eyewear glasses comprising an exterior box having a top, a bottom and four sidewalls along a first length, and an interior retention mechanism for holding a plurality of protective eyewear glasses along a second length. The exterior box completely receives the interior retention mechanism and securely holds the plurality of protective eyewear glasses in place. The exterior box includes a detachable area in proximity to the bottom to allow accessing one or more of the protective eyewear glasses held in place.

The interior retention mechanism may be substantially triangular in shape along the second length thereby allowing protective eyewear glasses to securely wrap around the interior retention mechanism. The protective eyewear glasses may be loaded and presented to a user upside down, with the protruding frame element of the glasses providing a convenient place to grasp and remove the glasses without depositing fingerprints or contamination on the glasses or lenses.

It is a feature of at least one embodiment of the invention to provide a design for easily and securely holding protective eyewear glasses in a queue, and presenting the protective eyewear glasses to a user in a manner to reduce fingerprints or contamination when retrieved.

Removal of a pair of protective eyewear glasses allows remaining protective eyewear glasses along the interior retention mechanism to slide downward to the bottom with gravity when the exterior box is positioned upright.

It is a feature of at least one embodiment of the invention to provide a mechanism for easy distribution of protective eyewear glasses without compromising the integrity of the package and potentially disheveling the contents of the box.

A spacer may be held within the exterior box between the end of the second length of the interior retention mechanism and the remaining portion of the first length of the exterior box for securely holding the interior retention mechanism in the exterior box.

It is a feature of at least one embodiment of the invention to securely hold the interior retention mechanism in place with respect to the exterior box.

The spacer held within the exterior box may be in proximity to the bottom. The spacer may also serve to position the protective eyewear glasses in such a way as to allow only one pair to be dispensed at time, thereby preventing the remaining protective eyewear glasses from falling out of the box and becoming contaminated or dirtied on the floor.

It is a feature of at least one embodiment of the invention to provide a rigid bottom for distribution of the protective eyewear glasses using an additional support.

An exterior enclosure may be used for rigidly supporting the exterior box.

It is a feature of at least one embodiment of the invention to provide reinforced support for the package on a reusable basis.

The exterior enclosure may comprise means for mounting the exterior enclosure to a wall.

It is a feature of at least one embodiment of the invention to provide a centralized location for the package for convenience and encouragement of use.

The interior retention mechanism can securely hold at least 24 protective eyewear glasses along the second length.

It is a feature of at least one embodiment of the invention to securely hold a bulk of protective eyewear glasses at a time.

An opening in a sidewall of the exterior box may be used for showing remaining protective eyewear glasses along the interior retention mechanism.

It is a feature of at least one embodiment of the invention to monitor the remaining protective eyewear glasses to facilitate timely reordering.

The opening may be in proximity to the bottom of the exterior box.

It is a feature of at least one embodiment of the invention to monitor nearing the end of protective eyewear glasses remaining.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
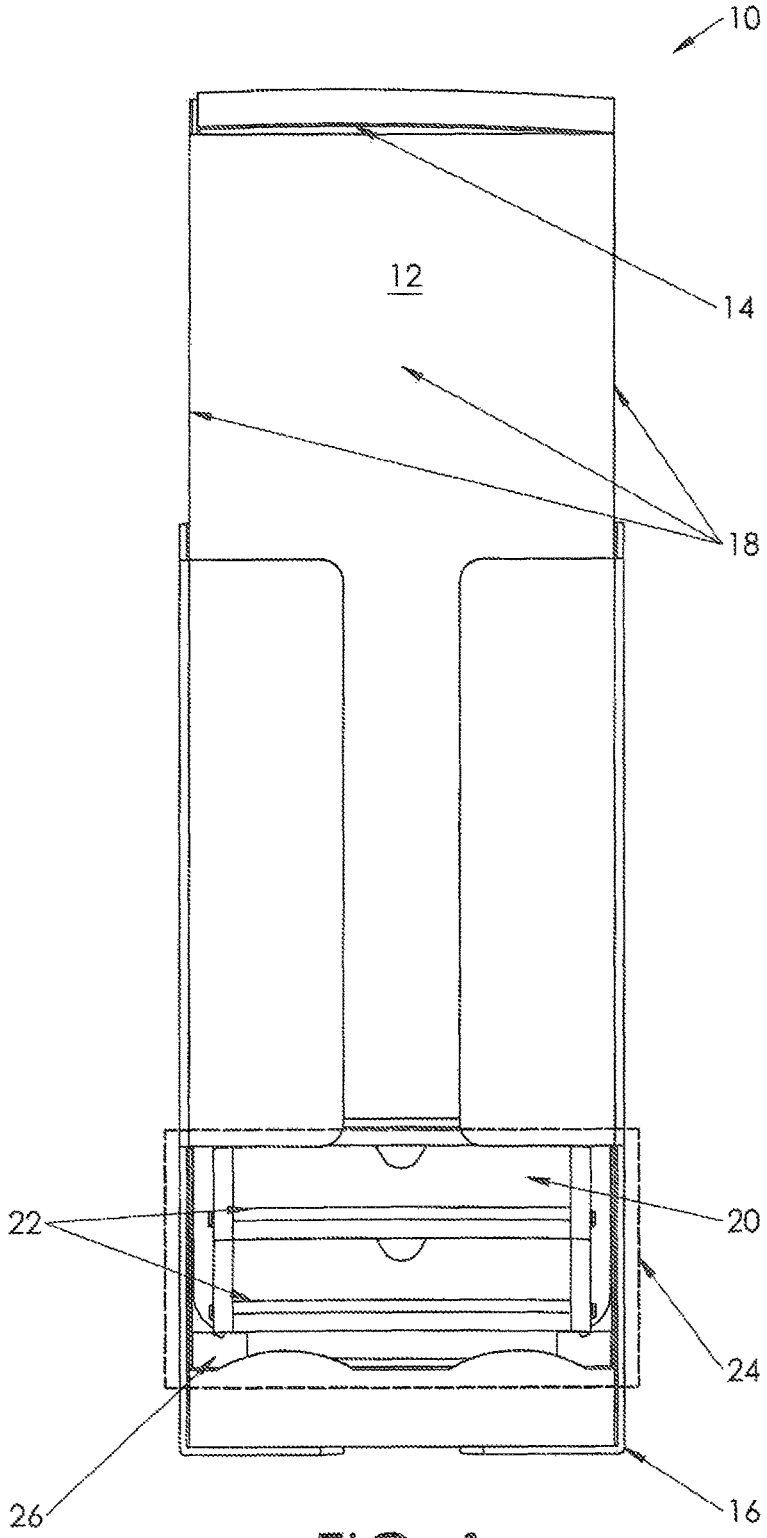
FIG. 1 illustrates a front perspective view of an assembled dispenser-package for storing and distributing protective eyewear glasses held in an exterior enclosure according to an embodiment of the invention.

In describing the preferred embodiment of the invention, which is illustrated in the drawings, specific terminology will be resorted to for the sake of clarity. However, it is not intended that the invention be limited to the specific terms so selected and it is to be understood that each specific term includes all technical equivalents, which operate in a similar manner to accomplish a similar purpose. For example, the words "connected," "attached," or terms similar thereto are often used. They are not limited to direct connection but include connection through other elements where such connection is recognized as being equivalent by those skilled in the art.

DETAILED DESCRIPTION OF PREFERRED EMBODIMENTS

The present invention and the various features and advantageous details thereof are explained more fully with reference to the non-limiting embodiments described in detail in the following description.

A dispenser-package for storing protective eyewear glasses and methods concerning the same are hereby disclosed. Beginning with FIG. 1, an assembled dispenser-package 10 for storing protective eyewear glasses comprises an exterior box 12 having a top 14, a bottom 16 and four sidewalls 18 along a first length from the top 14 to the bottom 16. The dispenser-package 10 may be manufactured, for example, from conventional cardboard or paper. An interior retention mechanism 20 holds a plurality of protective eyewear glasses 22 along a second length from the top of the interior retention mechanism 20 to the bottom of the interior retention mechanism 20. The exterior box 12 completely receives the interior retention mechanism 20 and securely holds the plurality of protective eyewear glasses 22 in place.

The exterior box 12 includes a detachable area 24 in proximity to the bottom 16 of exterior box 12 to allow accessing one or more of the protective eyewear glasses 22 held in place at a time. The detachable area 24 may be formed by perforations in the exterior box 12, and may include one or more tabs for ease of removal of the detachable area 24. As a result, the exterior box 12 in a first state, e.g., during shipment, may be fully enclosed without openings, while the exterior box 12 in a second state, e.g., during use in a healthcare facility, has an opening defined by the detachable area 24. The exterior box 12 may include indentations, impressions, cut-lines and/or any other features facilitating area removal on or in proximity to the detachable area 24 to further facilitate such removal.

Figure 15:
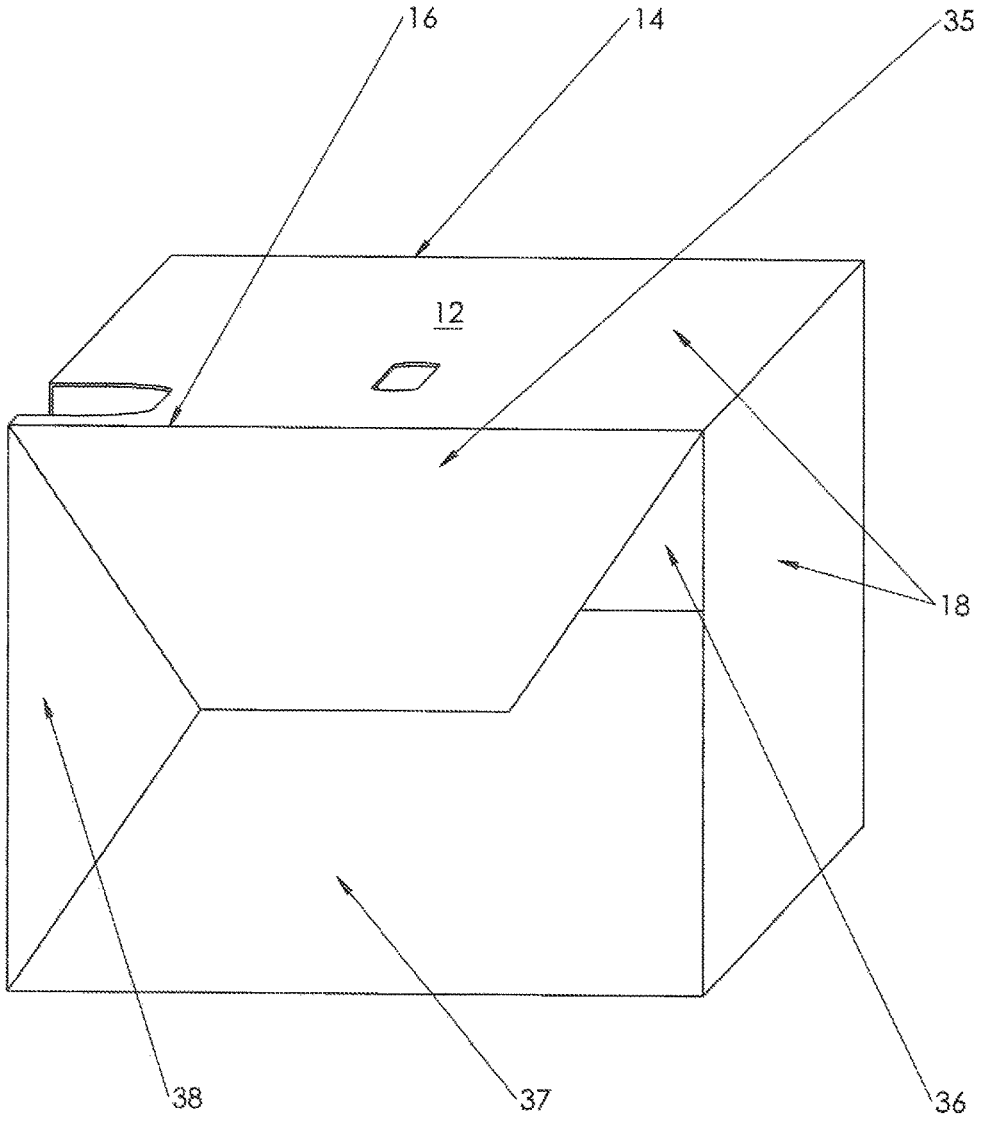
FIG. 15 illustrates a bottom perspective view of the assembled dispenser-package as shown in FIG. 1.
Figure 16:
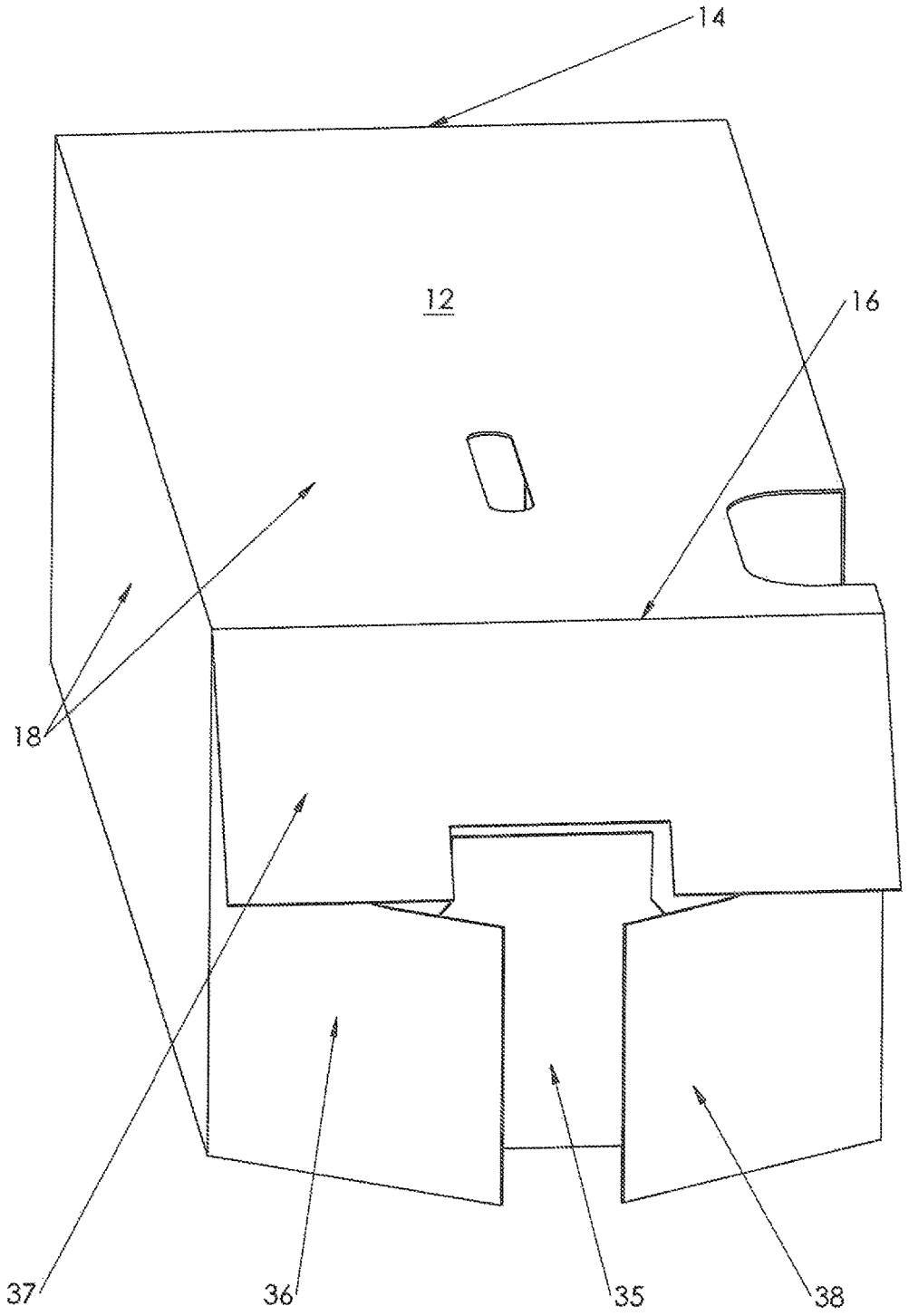
FIG. 16 illustrates the bottom perspective view of FIG. 15 with bottom flaps opened.

The exterior box 12 may also include a spacer 26 held within the exterior box 12 between the end of the second length of the interior retention mechanism 20 and the remaining portion of the first length of the exterior box 12 for securely holding the interior retention mechanism 20 in the exterior box 12. As such, the spacer 26 minimizes movement of the interior retention mechanism 20 within the exterior box 12. In a preferred embodiment, the spacer 26 is in proximity to the bottom of the exterior box 12 to increase rigidity of the bottom 16 after the detachable area 24 is removed. Accordingly, the spacer may serve to position the protective eyewear glasses 22 such that only one pair may be dispensed at time, thereby preventing remaining protective eyewear glasses 22 from falling out of the box and becoming contaminated or dirtied on the floor. In lieu of the spacer 26, or in addition thereto, folds in the the exterior box 12 and/or the interior retention mechanism 20, and/or stronger materials thereof, may provide equivalent functionality as desired. For example, as depicted in FIGS. 15 and 16, at the bottom 16, each side may fold in toward the center, and/or one side may include a flap that inserts into a slit on the opposing side, to securely hold the bottom 16 in position and to evenly withstand increased weight from above, with or without inclusion of the spacer 26.

An exterior enclosure 28 substantially surrounds the exterior box 12 for rigidly supporting the exterior box 12. The exterior enclosure 28 may comprise surrounding sides and a bottom for rigidly supporting the exterior box 12, while leaving the top open and accessible to facilitate ease of insertion and removal of the exterior box 12. The exterior enclosure 28 may be manufactured from any cost-effective, rigid material, such as plastic, and in a preferred embodiment, is manufactured from a rigid, transparent plastic.

The exterior enclosure 28 also comprises means for mounting the exterior enclosure 28 to a wall or other sturdy surface. In particular, the exterior enclosure 28 may include holes for positioning onto wall mounted screws, nails, hooks, or other fasteners, or may include hooks or other fasteners, adhesives, hook and loop fabric, angling of the exterior enclosure 28 for hanging over a surface, or any other similar mounting mechanism as known in the art.

In operation, the exterior box 12 containing the plurality of protective eyewear glasses 22 may arrive at a healthcare facility. The exterior box 12 may be alone or among other exterior boxes 12 in a larger shipping box, or the exterior box 12 may also serve as the shipping box with appropriate shipping labels affixed thereto. At the healthcare facility, the exterior box 12 may be inserted into the (empty) exterior enclosure 28 which is mounted in an appropriate and accessible location in the healthcare facility. Then, the detachable area 24 is removed by tearing away along perforations defining the detachable area 24 from the area in proximity to the bottom 16 of exterior box 12.

Next, one or more of the protective eyewear glasses 22 are retrieved through the area now exposed by removal of the detachable area 24. Removal of a single pair of protective eyewear glasses 22 allows remaining protective eyewear glasses 22 along the interior retention mechanism 20 to slide downward to the bottom with gravity when the exterior box 12 is positioned upright. Finally, once all of the protective eyewear glasses 22 have been removed, the exterior box 12 is removed from exterior enclosure 28 and a replacement exterior box 12 is inserted into the (empty) exterior enclosure 28 and the process is repeated.

In accordance with an embodiment, a method for storing the protective eyewear glasses 22 may comprise holding the plurality of protective eyewear glasses 22 in place along the length of the interior retention mechanism 20, and placing the interior retention mechanism 22 completely in the exterior box 18. The exterior box 18, again, includes the detachable area 24 in proximity to the bottom to allow accessing one or more of the protective eyewear glasses 22 held in place.

Figure 2:
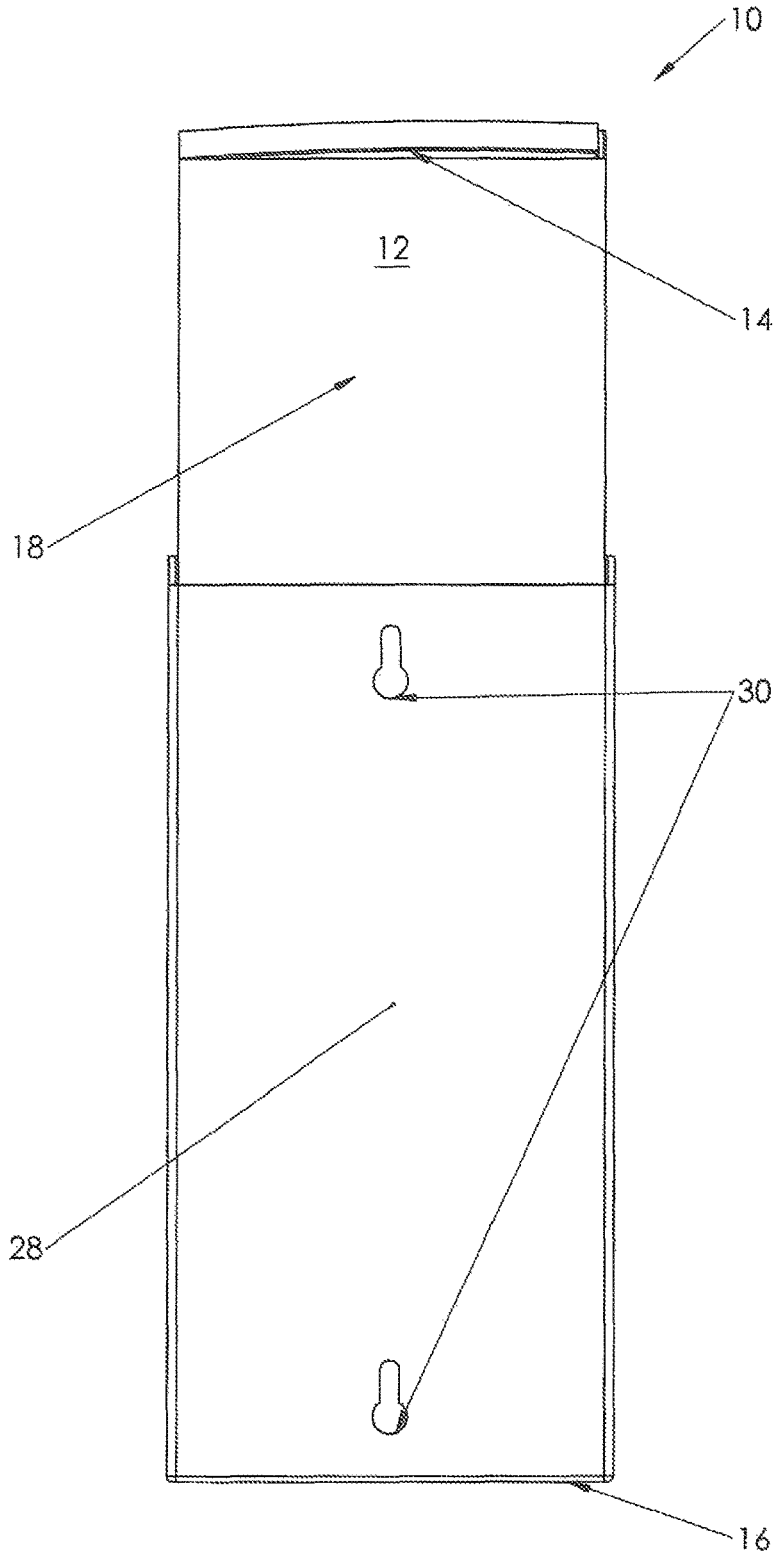
FIG. 2 illustrates a rear perspective view of the assembled dispenser-package as shown in FIG. 1.
Figure 3:
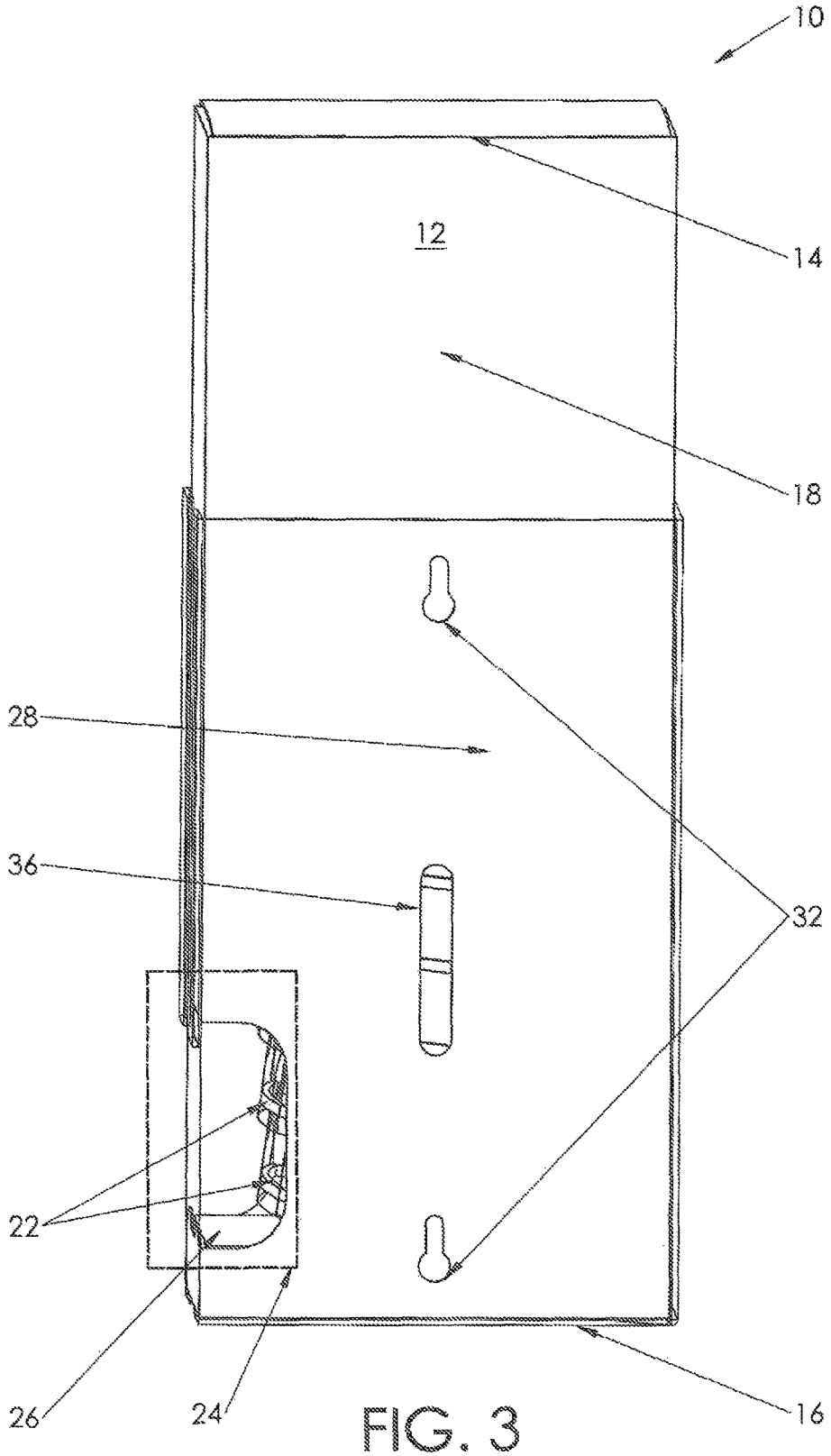
FIG. 3 illustrates a left side perspective view of the assembled dispenser-package as shown in FIG. 1.
Figure 4:
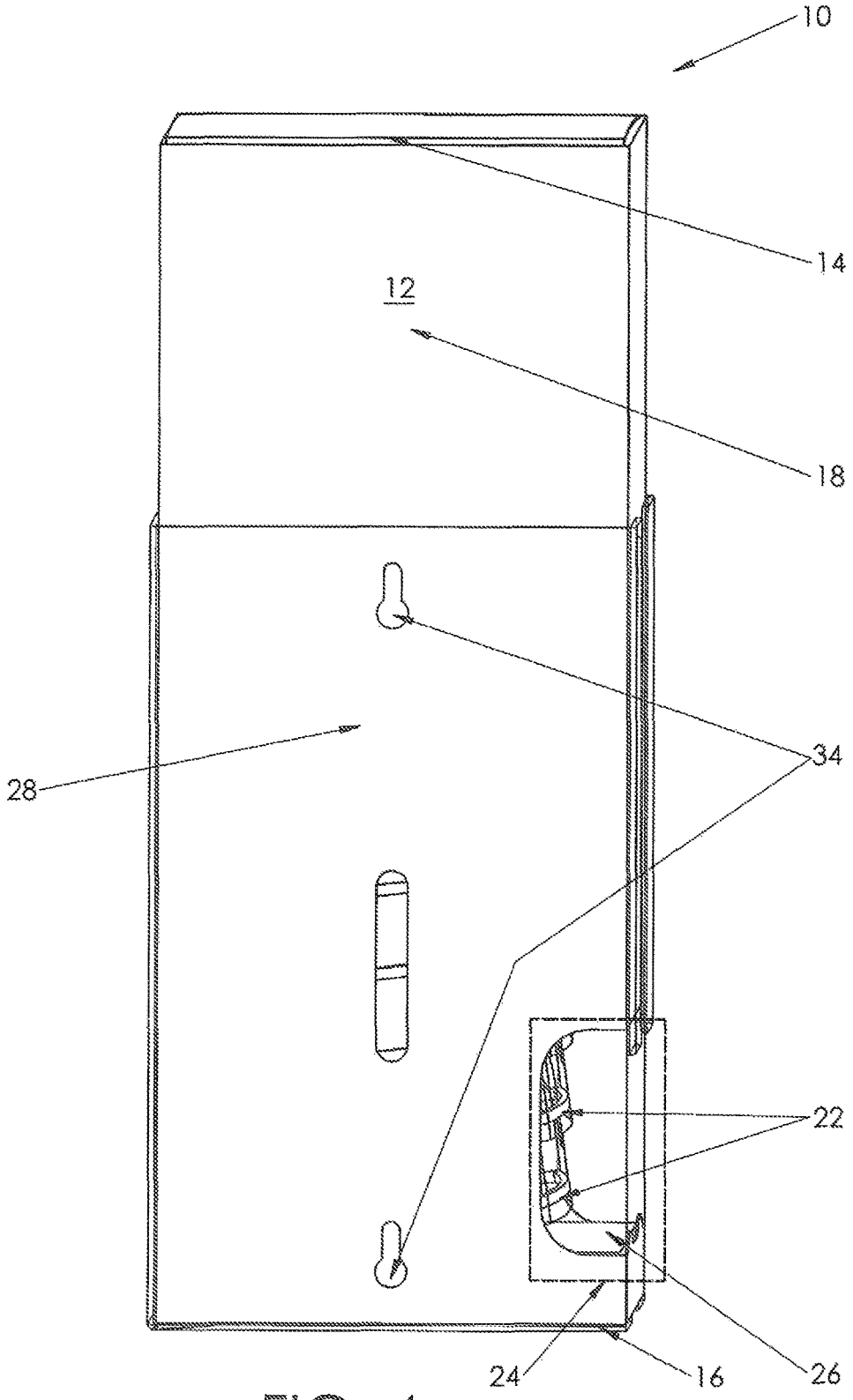
FIG. 4 illustrates a right side perspective view of the assembled dispenser-package as shown in FIG. 1.

Turning now to FIGS. 2-4, rear, left and right side perspective views of the assembled dispenser-package 10 of FIG. 1 are shown, respectively. The rear of the exterior enclosure 28 includes a pair of mounting holes with grooves 30 for wall mounting. Similarly, the left side and the right side of the exterior enclosure 28 also include pairs of mounting holes with grooves 32 and 34, respectively, for wall mounting.

In addition, the left side and the right side of the exterior box 12 include openings 36 and 38, respectively, in sidewalls 18 of the exterior box 12, for showing remaining protective eyewear glasses along the interior retention mechanism 20 to facilitate timely reordering. The openings 36 and 38 in sidewalls 18 are visible through the transparent exterior enclosure 28. In a preferred embodiment, the opening openings 36 and 38 are in proximity to the bottom of the exterior box to monitor nearing the end of protective eyewear glasses 22 remaining.

An indicia for facilitating reordering of the protective eyewear glasses 22 may also appear on the exterior box 12. The indicia may be, for example, a Quick Response ("QR") Code, a barcode, a reorder number, reorder instructions, an Internet address, and so forth, which may be linked to or otherwise facilitate reordering of the protective eyewear glasses 22. In a preferred embodiment, the indicia may be in proximity to the openings 36 and 38 such that monitoring nearing the end of the protective eyewear glasses 22 may conveniently accompany reordering the protective eyewear glasses 22.

Figure 5:
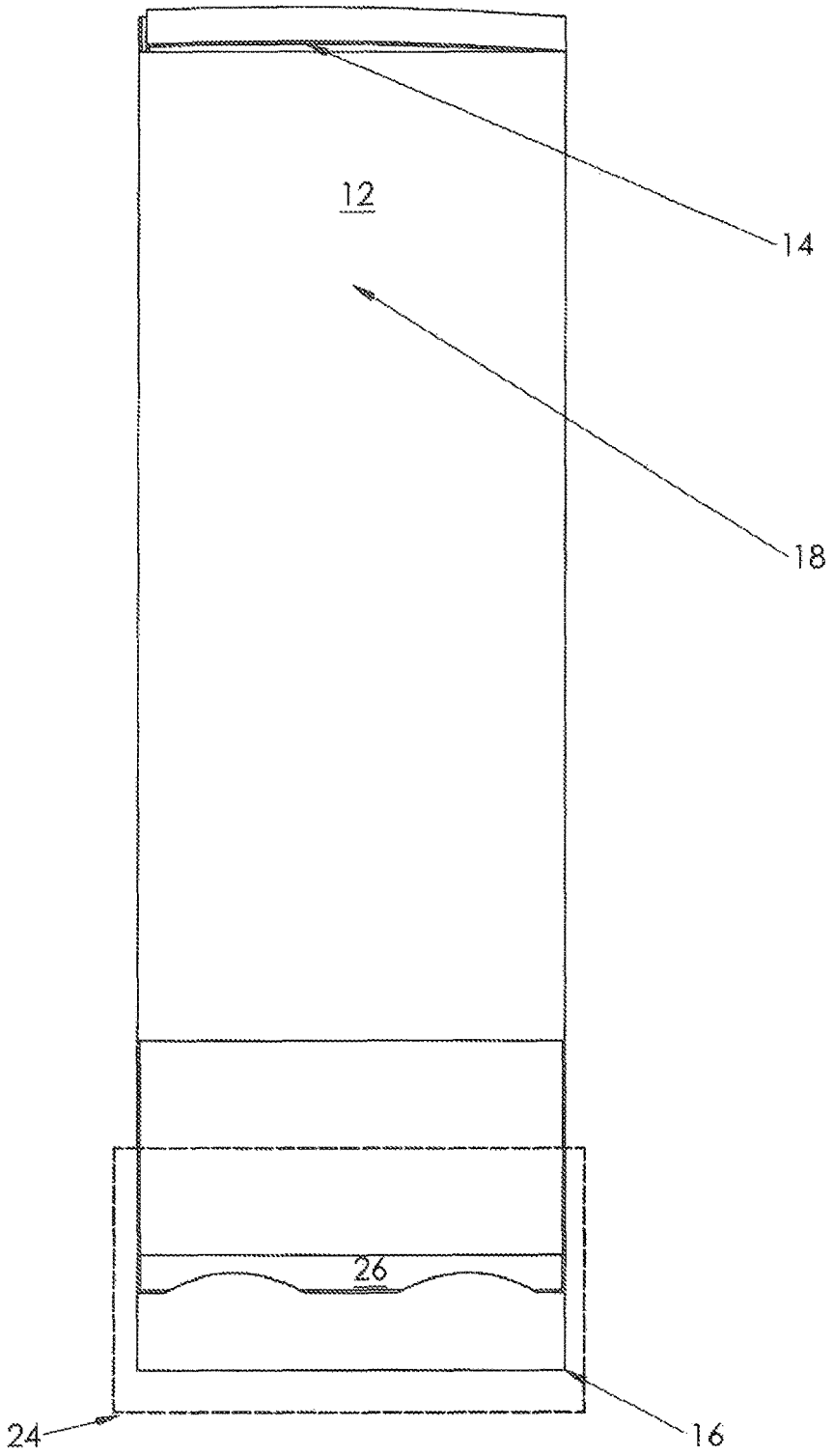
FIG. 5 illustrates a front perspective view of the exterior box of FIG. 1.
Figure 6:
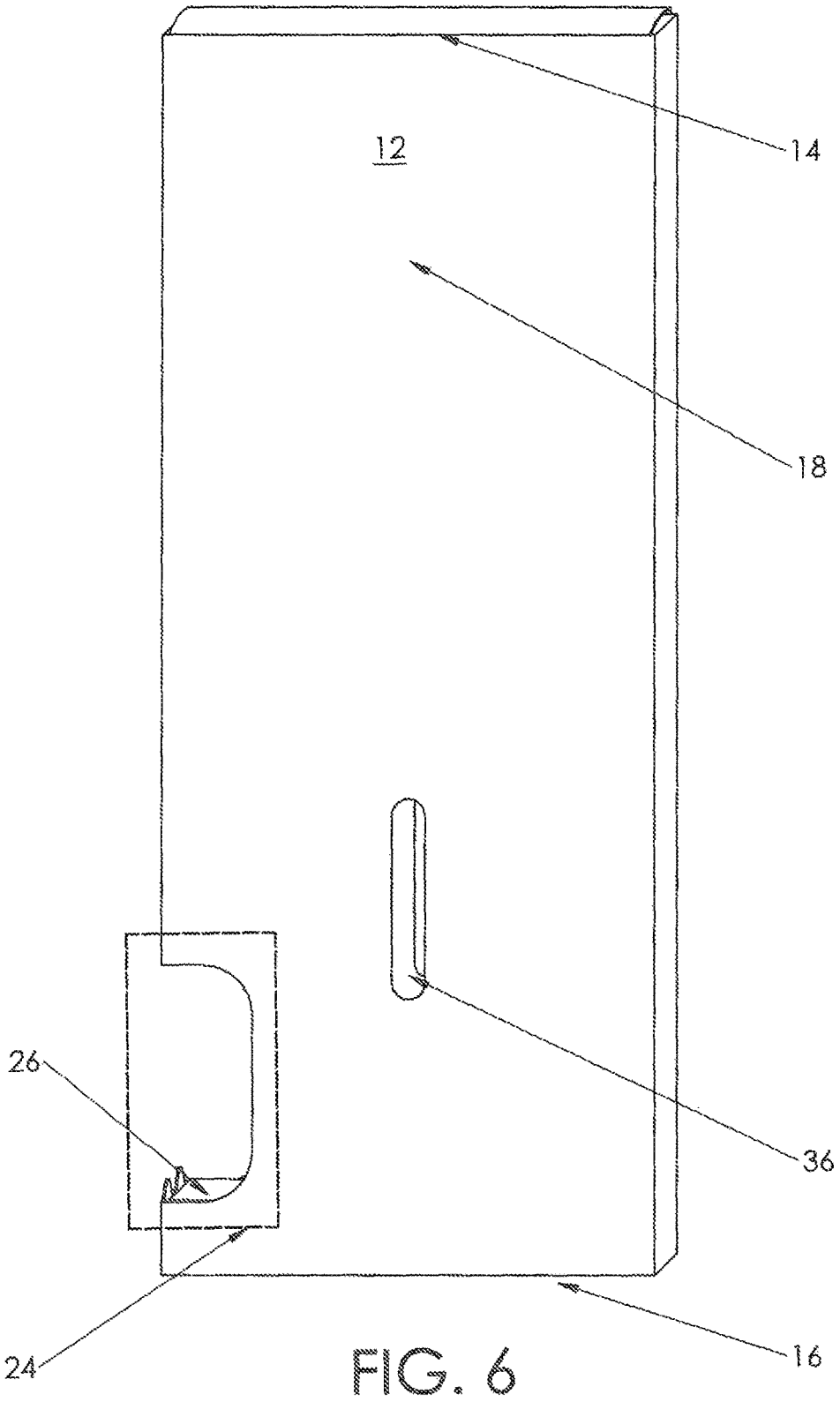
FIG. 6 illustrates a left side perspective view of the exterior box of FIG. 1.
Figure 7:
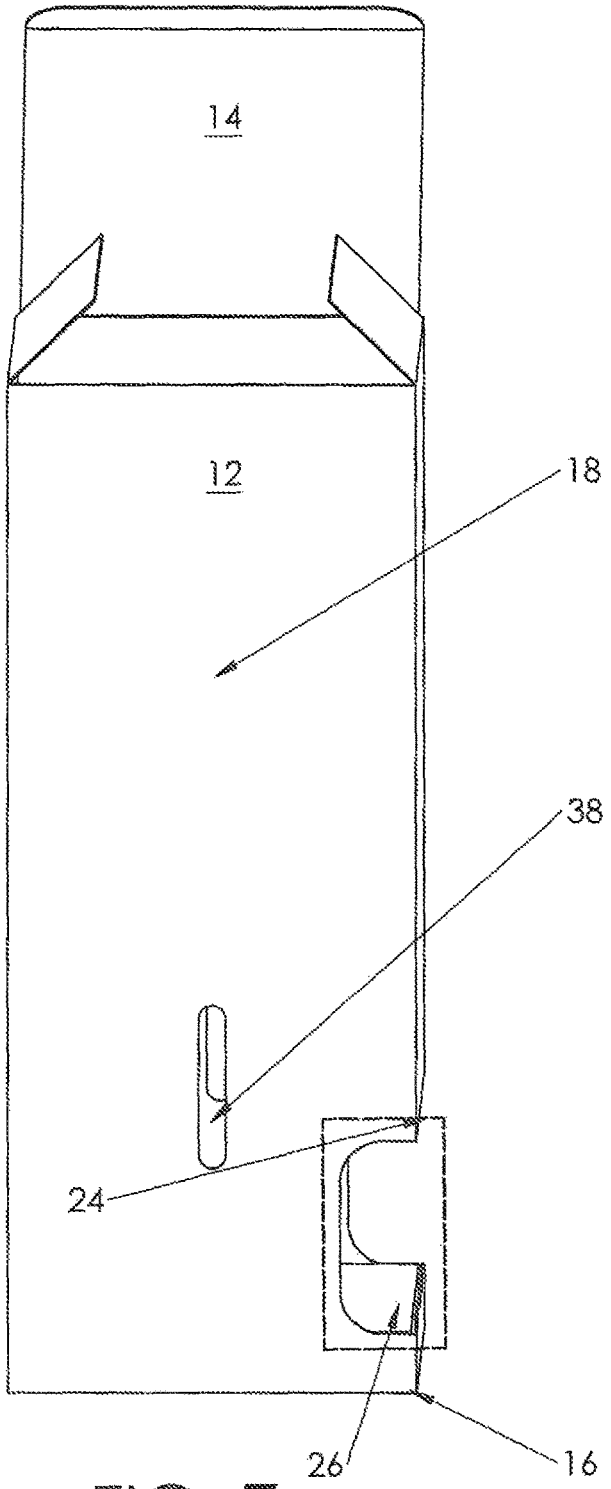
FIG. 7 illustrates a right side perspective view of the exterior box of FIG. 1.

Turning now to FIGS. 5-7, front, left and right side perspective views of the exterior box 12 of FIG. 1 are shown, respectively. The top 14 and the bottom 16 of the exterior box 12 may comprise a plurality of flaps for sealing the top 14 together and the bottom 16 together as in conventional boxes. In addition, the exterior box 12 may collapse flat when the plurality of flaps for sealing the top 14 and the bottom 16 are fully opened, as in conventional boxes.

Figure 8:
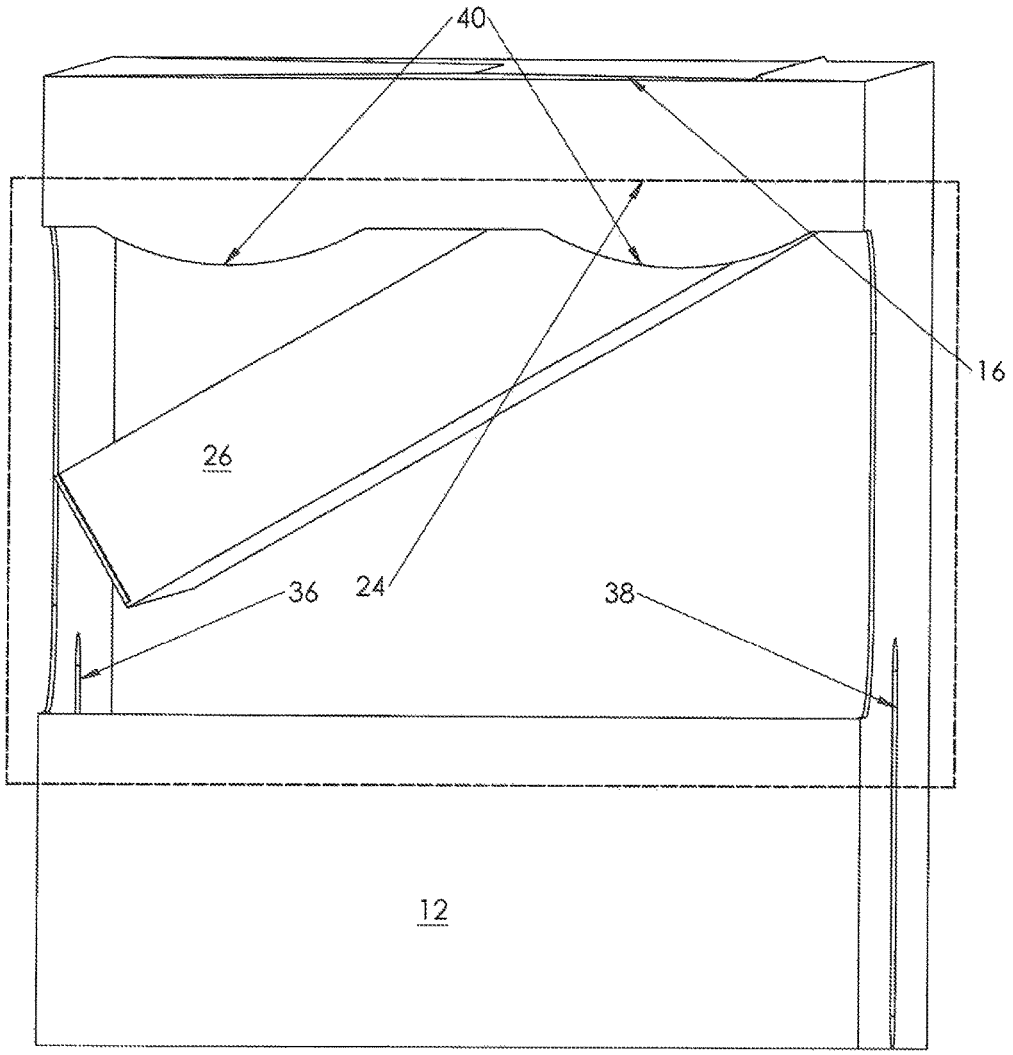
FIG. 8 illustrates a detachable area in proximity to the bottom of the exterior box of FIG. 1 to allow accessing one or more of the protective eyewear glasses held in place.

Turning now to FIG. 8, a closer view of the detachable area 24 of the exterior box 12 of FIG. 1 is shown. Removal of the detachable area 24 allows accessing one or more of the protective eyewear glasses 22 when present. Impression areas 40 located in proximity to the lower side of the detachable area 24 allow ease of removal of the detachable area 24 by pushing against the impression areas 40 to begin breaking perforations that form the detachable area 24. Alternative embodiments for the detachable area 24 may provide indentations, cut-lines, removable adhesives and/or other techniques as known in the art.

As shown in FIG. 8, the spacer 26 is lifted upward from the bottom 16 of the exterior box 12 to reveal its additional detail. Accordingly, the spacer 26 may comprise a separate, detachable piece from the exterior box 12 formed of cardboard or paper folded together. An alternative embodiment may provide a spacer that is formed as part of the exterior box.

Figure 9:
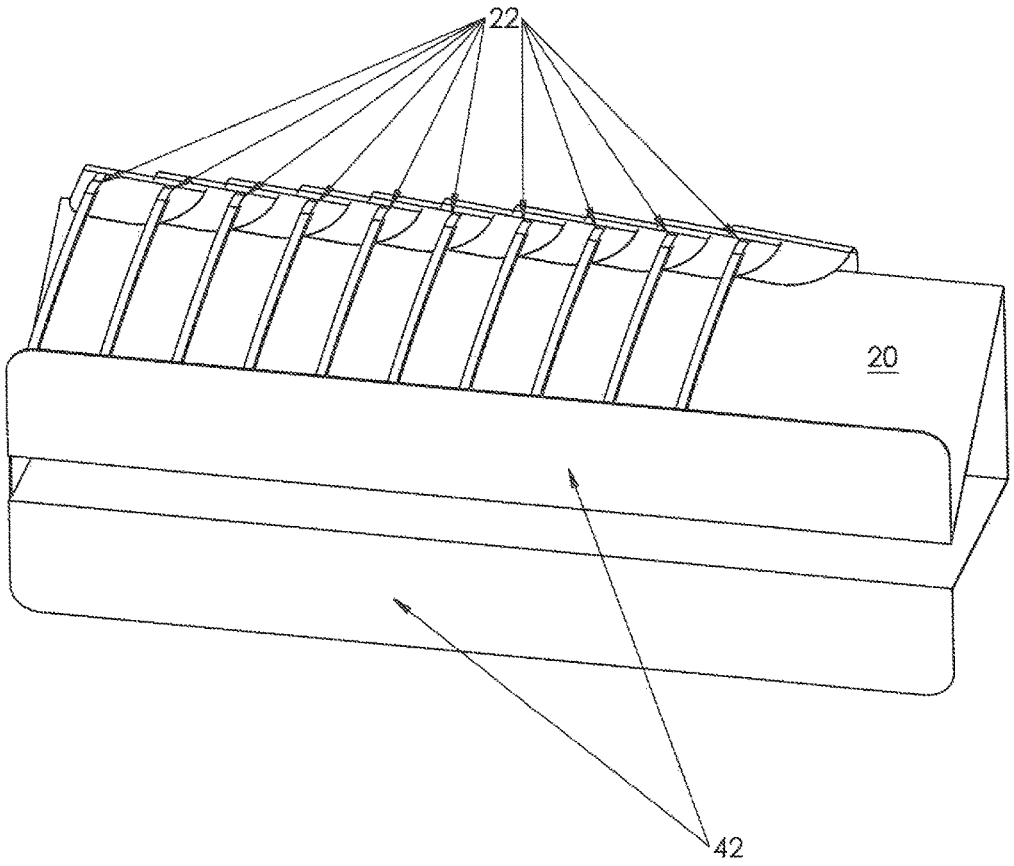
FIG. 9 illustrates an interior retention mechanism for holding the plurality of protective eyewear glasses according to an embodiment of the invention.

Turning now to FIG. 9, the interior retention mechanism 20 holds the plurality of protective eyewear glasses 22 according to an embodiment of the invention. The interior retention mechanism 20 may be substantially triangular in shape along its length thereby allowing the arms of the protective eyewear glasses 22 to securely wrap around the interior retention mechanism 20. As shown in the figures, the interior retention mechanism 20 may in fact appear trapezoidal in shape with respect to the exterior box 12, although other shapes may be used, so long as they are conducive to retention of the protective eyewear glasses 22 within the exterior box 12. As a result, the protective eyewear glasses 22 may be loaded and presented to a user upside down, with the protruding frame element of the protective eyewear glasses 22 providing a convenient place to grasp and remove the protective eyewear glasses 22 without depositing fingerprints or contamination on the protective eyewear glasses 22 or their lenses. The interior retention mechanism 20 is sized to substantially secure against the exterior box 12 when the exterior box 12 receives the interior retention mechanism 20.

The interior retention mechanism 20 includes folding flaps 42 along its length, and along the apex area of the substantially triangular shape. The folding flaps 42 further allow guiding of the interior retention mechanism 20 into the exterior box 12, further provide securely holding the protective eyewear glasses 22 inside the exterior box 12, and further provide rigidity for the exterior box 12 once assembled.

Figure 10:
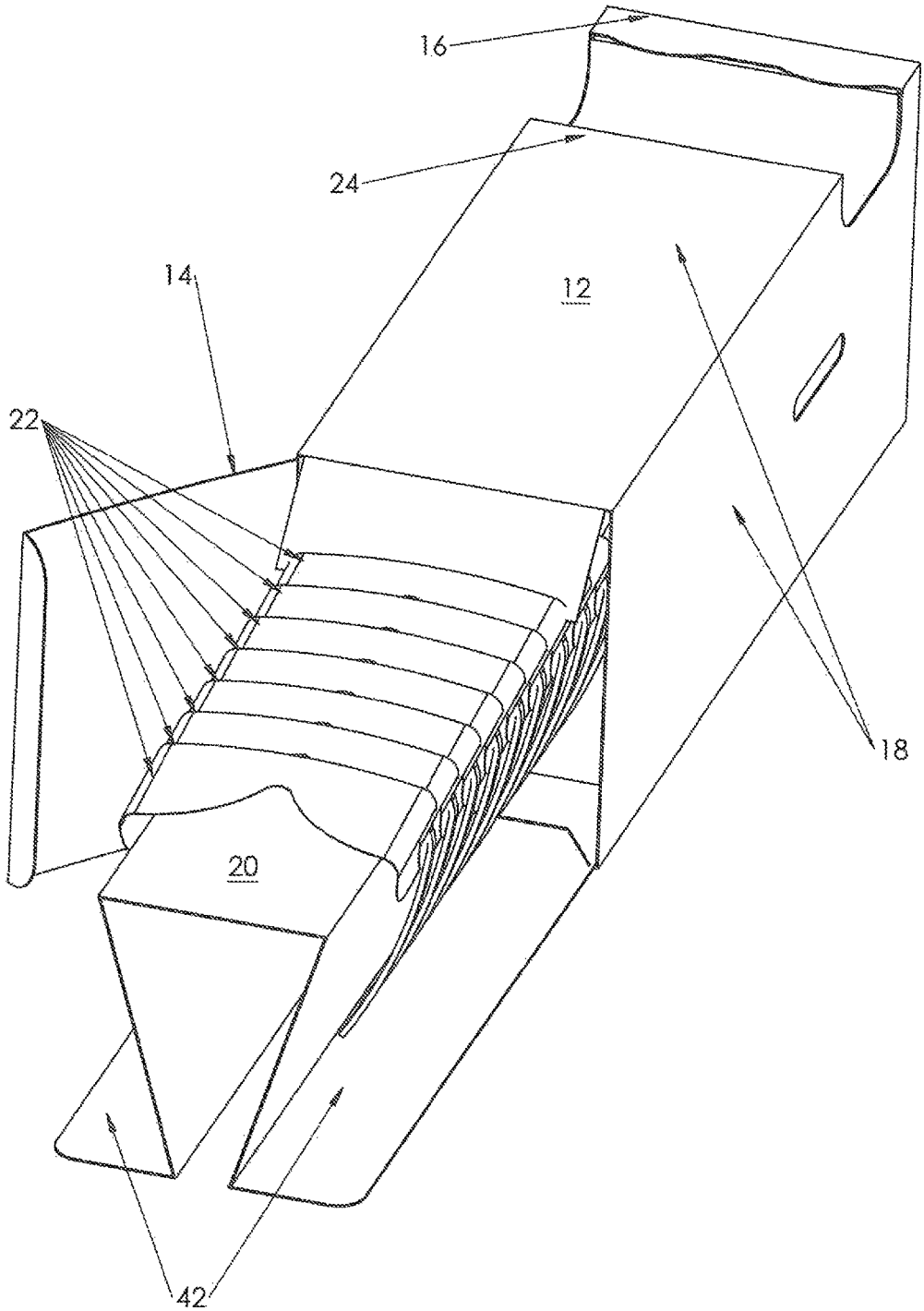
FIG. 10 illustrates the exterior box of FIG. 1 receiving the interior retention mechanism of FIG. 9 for securely holding the plurality of protective eyewear glasses in place.
Figure 11:
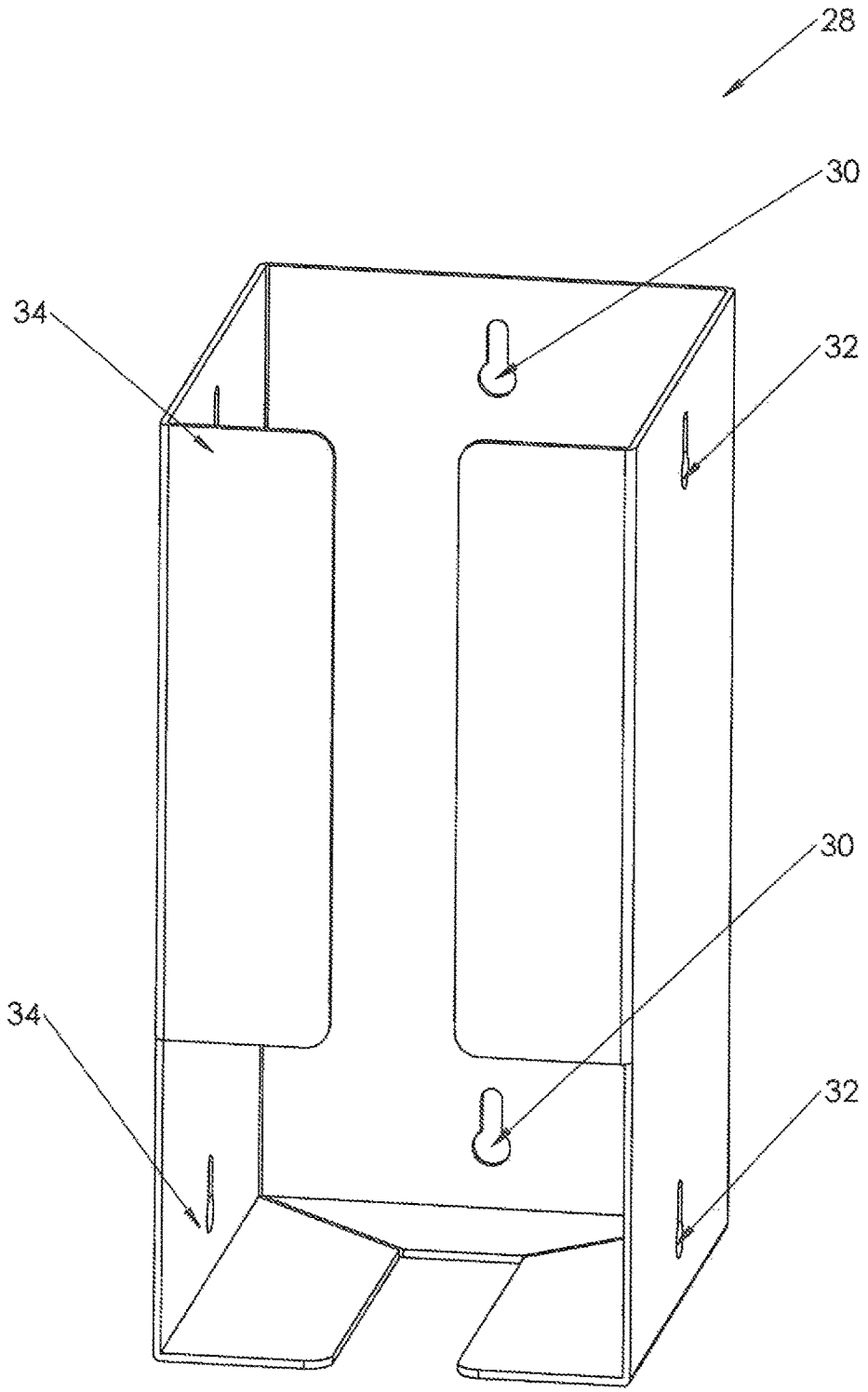
FIG. 11 illustrates a front perspective view of the exterior enclosure for rigidly supporting the exterior box of FIG. 1.
Figure 12:
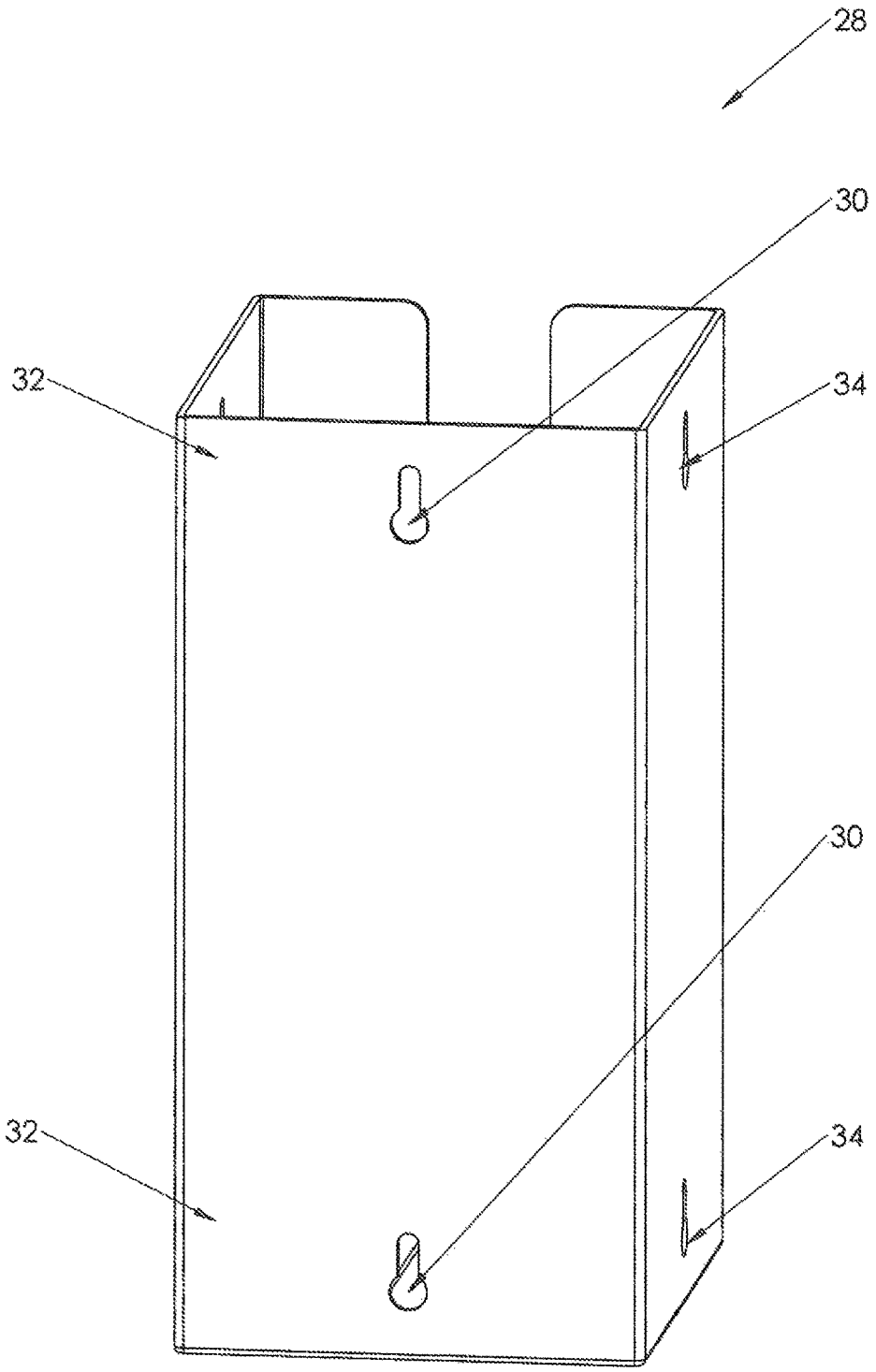
FIG. 12 illustrates a rear perspective view of the exterior enclosure of FIG. 11.
Figure 13:
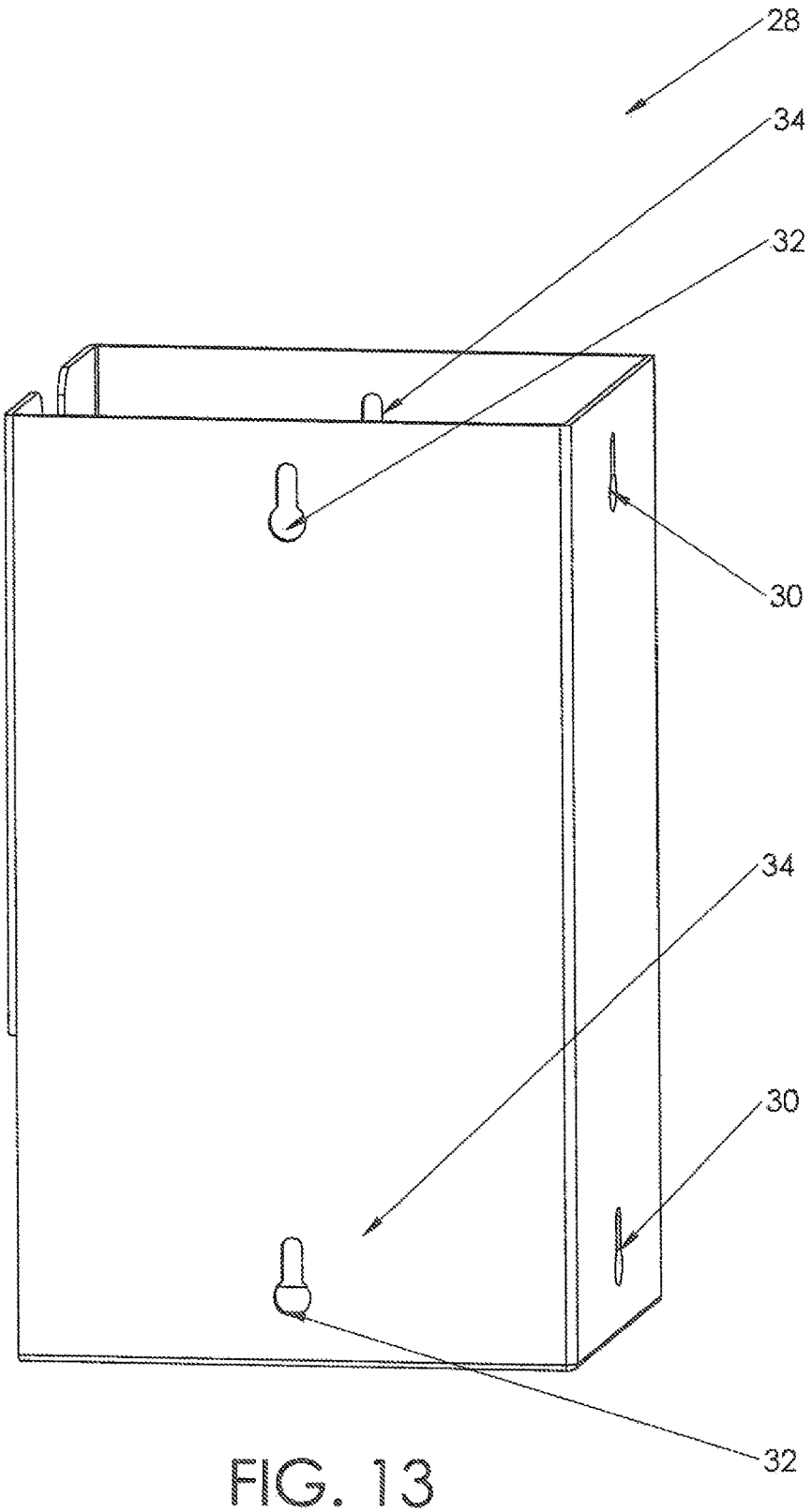
FIG. 13 illustrates a left side perspective view of the exterior enclosure of FIG. 11.
Figure 14:
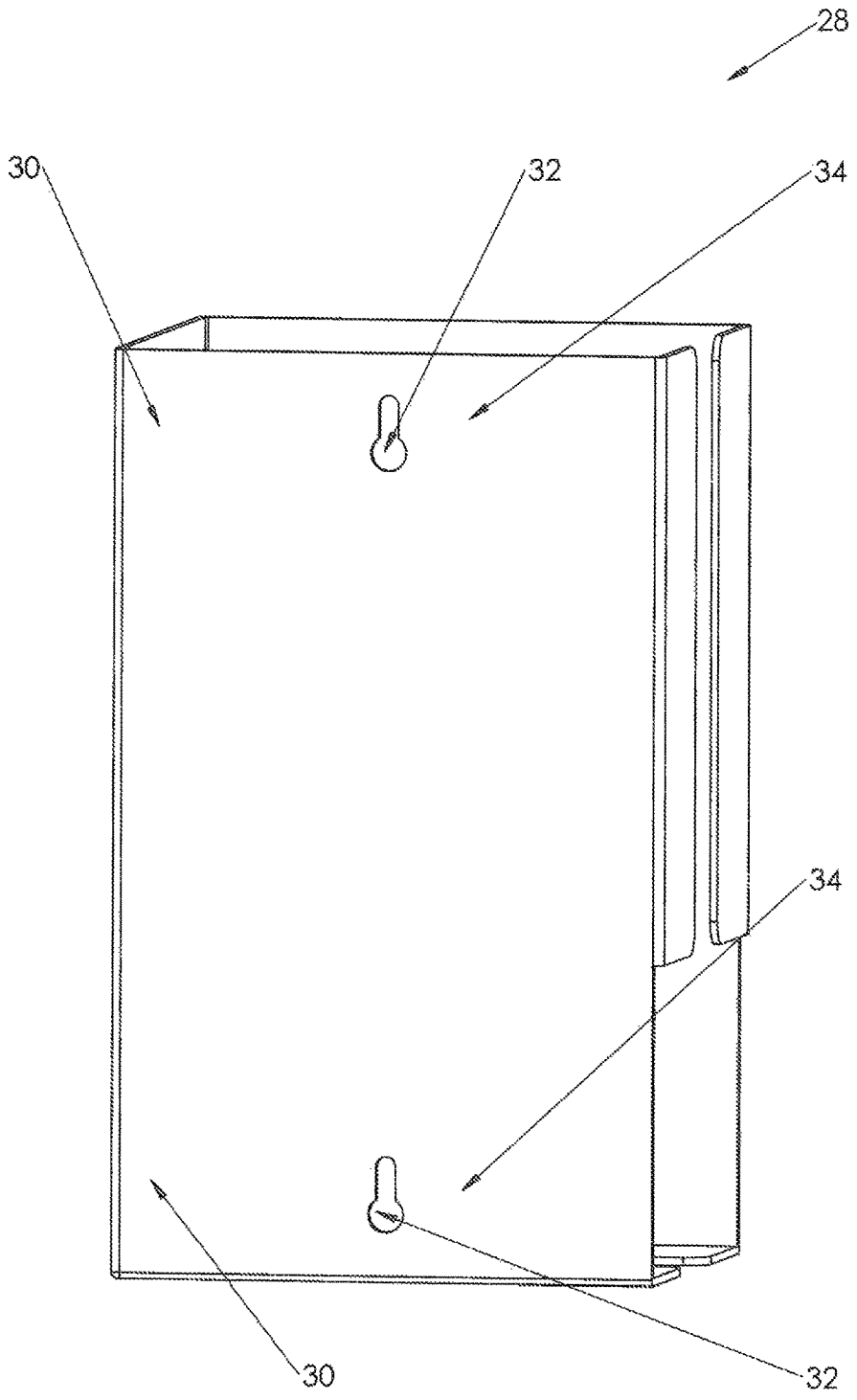
FIG. 14 illustrates a right side perspective view of the exterior enclosure of FIG. 11.

Turning now to FIG. 10, the exterior box 12 completely receives the interior retention mechanism 20 for securely holding the plurality of protective eyewear glasses 22 in place. The interior retention mechanism 20 slides into the exterior box 12 through the top 14 of the exterior box 12.

Turning now to FIGS. 11-14, front, rear, left and right side perspective views of the exterior enclosure 28 of FIG. 1 are shown, respectively. The exterior enclosure 28 is a transparent plastic and provides rigid support for the exterior box 12. The rear of the exterior enclosure 28 includes the pair of mounting holes with grooves 30 for wall mounting. Similarly, the left side and the right side of the exterior box 12 also include the pairs of mounting holes with grooves 32 and 34, respectively, for wall mounting.

FIG. 15 illustrates a bottom perspective view of the assembled dispenser-package as shown in FIG. 1; and FIG. 15 illustrates the bottom perspective view of FIG. 15 with bottom flaps opened.

Additional features of a dispenser-package for storing protective eyewear glasses are shown in the illustrations in Appendix A attached hereto.

The individual components need not be formed in the disclosed shapes, or assembled in the disclosed configuration, but could be provided in virtually any shape and assembled in virtually any configuration. Further, although various embodiments of eye protection, face shields, head bands, and dispensers are described herein with certain features, any of the features may be combined with or removed from any of the embodiments. Furthermore, all the disclosed features of each dispenser may be combined with, or substituted for, the disclosed features of every other embodiment.

It is intended that the appended claims cover all such additions, modifications and rearrangements. Expedient embodiments of the present invention are differentiated by the appended claims.

What is claimed is:

1. A dispenser-package for storing protective eyewear glasses, comprising:

a plurality of protective eyewear glasses having lenses and arms;

an exterior box having a plurality of walls, including a short wall providing a top, a short wall providing a bottom and four long walls providing sidewalls; and interior walls forming an interior retention mechanism for holding the plurality of protective eyewear glasses along a length of the interior retention mechanism;

wherein the exterior box completely receives the interior retention mechanism to securely hold the plurality of protective eyewear glasses in place;

wherein the exterior box includes perforations forming a detachable area in at least one of the sidewalls to allow accessing one or more of the protective eyewear glasses held in place;

wherein the interior retention mechanism is configured to support the plurality of protective eyewear glasses by arranging the arms of the protective eyewear glasses around the interior retention mechanism and between the interior retention mechanism and opposing sidewalls of the exterior box;

wherein the plurality of protective eyewear glasses are arranged alone the length of the interior retention mechanism, and along the sidewalls from the bottom to the top, with the protective eyewear glasses being arranged one above another along the length with the arms of each of the protective eyewear glasses being in contact with the interior retention mechanism at separate points;

wherein a plurality of the protective eyewear glasses slide along the interior retention mechanism toward the detachable area for removal from the dispenser-package; and wherein each of the plurality of the protective eyewear glasses are supported by lower protective eyewear glasses except for a last remaining of the protective eyewear glasses.

2. The dispenser-package of claim 1, wherein the interior retention mechanism is substantially trapezoidal in shape with respect to the exterior box.

3. The dispenser-package of claim 1, wherein removal of a pair of protective eyewear glasses allows remaining protective eyewear glasses along the interior retention mechanism to slide downward to the bottom with gravity when the exterior box is positioned upright.

4. The dispenser-package of claim 1, further comprising a spacer held within the exterior box between an end of a second length of the interior retention mechanism and a remaining portion of a first length of the exterior box for securely holding the interior retention mechanism in the exterior box.

5. The dispenser-package of claim 4, wherein the spacer held within the exterior box is in proximity to the bottom.

6. The dispenser-package of claim 1, further comprising an exterior enclosure comprising surrounding sides and a bottom for rigidly supporting the dispenser-package.

7. The dispenser-package of claim 6, wherein the exterior enclosure includes mounting holes for mounting the dispenser-package to a wall.

8. The dispenser-package of claim 1, wherein the interior retention mechanism can securely hold at least 20 protective eyewear glasses in the exterior box.

9. The dispenser-package of claim 1, further comprising an opening in a sidewall of the exterior box for showing remaining protective eyewear glasses along the interior retention mechanism.

10. A dispenser-package for storing protective eyewear glasses, comprising:

a plurality of protective eyewear glasses having lenses and arms;

an exterior box having a plurality of walls, including a short wall providing a top, a short wall providing bottom and four long walls providing sidewalls along a first length, wherein the first length is greater than a width of the exterior box;

interior walls forming an interior retention mechanism for holding the plurality of protective eyewear glasses along an interior length of the interior retention mechanism, wherein the exterior box completely receives the interior retention mechanism to securely hold the plurality of protective eyewear glasses in place;

an opening in a sidewall of the exterior box for showing remaining protective eyewear glasses; and perforations forming a detachable area in the exterior box formed by perforations in proximity to the bottom, wherein removal of the detachable area allows individually accessing the protective eyewear glasses held in place, wherein the interior retention mechanism is configured so that removal of an individual pair of protective eyewear glasses allows the remaining protective eyewear glasses to slide downward along the second length to the bottom with gravity when the exterior box is positioned upright, wherein the interior retention mechanism is configured to support the plurality of protective eyewear glasses by arranging the arms of the protective eyewear glasses around the interior retention mechanism and between the interior retention mechanism and opposing sidewalls of the exterior box, wherein the plurality of protective eyewear glasses are arranged along the interior length of the interior retention mechanism, and along the sidewalls from the bottom to the top, with the protective eyewear glasses being arranged one above another along the interior length with the arms of each of the protective eyewear glasses being in contact with the interior retention mechanism at separate points.

11. The dispenser-package of claim 10, further comprising an exterior enclosure for rigidly supporting the exterior box, wherein the exterior enclosure includes mounting holes for mounting the dispenser-package to a wall, and wherein the interior retention mechanism can securely hold at least 24 protective eyewear glasses along the second length.

12. A system for storing and dispensing protective eyewear glasses, comprising:

a plurality of protective eyewear glasses having lenses and arms;

an exterior box having a plurality of walls, including:

(a) a short wall providing a top;

(b) a short wall providing a bottom;

(c) four long walls providing sidewalls along a first length from the top to the bottom; and (d) perforations forming a detachable area in at least one of the sidewalls, wherein removal of the detachable area defines an opening in the at least one of the sidewalls; and interior walls forming an interior retention mechanism having a second length, the interior retention mechanism being completely received within the exterior box, wherein the interior retention mechanism is configured to hold the plurality of protective eyewear glasses in place along the second length, wherein removal of the detachable area allows removal of one or more protective eyewear glasses through the opening, wherein the interior retention mechanism is configured to support the plurality of protective eyewear glasses by arranging the arms of the protective eyewear glasses around the interior retention mechanism and between the interior retention mechanism and opposing sidewalls of the exterior box, wherein the plurality of protective eyewear glasses are arranged along the second length of the interior retention mechanism, and along the sidewalls from the bottom to the top, with the protective eyewear glasses being arranged one above another along the second length with the arms of each of the protective eyewear glasses being in contact with the interior retention mechanism at separate points; wherein a plurality of the protective eyewear glasses slide along the interior retention mechanism toward the opening for removal through the opening, and wherein each of the plurality of the protective eyewear glasses are supported by lower protective eyewear glasses except for a last remaining of the protective eyewear glasses.

13. The system of claim 12, wherein the detachable area is in proximity to the bottom of the exterior box.

14. The system of claim 12, wherein the detachable area is formed by perforations in the exterior box.

15. The system of claim 12, further comprising a second opening in a sidewall of the exterior box for showing at least some of the plurality of protective eyewear glasses along the second length.

16. The system of claim 12, further comprising an exterior apparatus surrounding the bottom and one or more of the sidewalls of the exterior box for rigidly supporting the exterior box.

17. The system of claim 12, further comprising indicia on the exterior box for facilitating reordering of protective eyewear glasses.

18. The system of claim 12, wherein the interior retention mechanism is substantially trapezoidal in shape with respect to the exterior box.

19. The system of claim 12, wherein the interior retention mechanism can securely hold at least 20 protective eyewear glasses along the second length.

20. The system of claim 17, wherein the indicia on the exterior box comprises at least one of: a Quick Response Code, a barcode, a reorder number, reorder instructions, or an Internet address.

* * * * *